US007023134B2

(12) United States Patent
Shimoi et al.

(10) Patent No.: US 7,023,134 B2
(45) Date of Patent: Apr. 4, 2006

(54) DYNODE PRODUCING METHOD AND STRUCTURE

(75) Inventors: Hideki Shimoi, Hamamatsu (JP); Hiroyuki Kyushima, Hamamatsu (JP)

(73) Assignee: Hamamatsu Photonics K.K., Shizouka (JP)

( * ) Notice: Subject to any disclaimer, the term of this patent is extended or adjusted under 35 U.S.C. 154(b) by 52 days.

(21) Appl. No.: 10/311,586

(22) PCT Filed: Jun. 15, 2001

(86) PCT No.: PCT/JP01/05143

§ 371 (c)(1),
(2), (4) Date: Dec. 18, 2002

(87) PCT Pub. No.: WO01/99138

PCT Pub. Date: Dec. 27, 2001

(65) Prior Publication Data

US 2003/0137244 A1 Jul. 24, 2003

(51) Int. Cl.
*H01J 43/00* (2006.01)

(52) U.S. Cl. ..... 313/533; 313/534; 313/540; 313/103 R; 313/103 CM; 250/207

(58) Field of Classification Search ..... 313/533, 313/534, 532, 540–542, 103 R, 104, 103 CM, 313/105 R, 105 CM; 250/366, 207
See application file for complete search history.

(56) References Cited

U.S. PATENT DOCUMENTS 4,023,063 A 5/1977 King et al. ..... 313/400
4,575,657 A 3/1986 Kaiser ..... 313/533
5,410,211 A 4/1995 Kyushima ..... 313/103 R
5,491,380 A 2/1996 Kyushima et al. ..... 313/533
5,498,926 A 3/1996 Kyushima et al. ..... 313/533
5,510,674 A 4/1996 Kyushima et al. ..... 313/533
5,532,551 A 7/1996 Kyushima et al. ..... 313/533
5,572,089 A 11/1996 Kyushima et al. ..... 313/533
5,618,217 A * 4/1997 Then et al. ..... 445/35
5,619,100 A 4/1997 Kyushima et al. ..... 313/533
5,637,959 A 6/1997 Kyushima et al. ..... 313/533
5,744,908 A 4/1998 Kyushima ..... 313/533
5,801,511 A 9/1998 Kyushima et al. ..... 313/532
5,880,458 A 3/1999 Shimoi et al. ..... 250/207
5,917,281 A 6/1999 Shimoi et al. ..... 313/533
5,936,348 A 8/1999 Shimoi et al. ..... 313/533
6,491,831 B1 * 12/2002 Aibara ..... 216/12

FOREIGN PATENT DOCUMENTS

GB 2154053 A 8/1985
JP 46 111867 8/1973
JP 08-007825 1/1996
JP 11-329339 A 11/1999

* cited by examiner

*Primary Examiner*—Karabi Guharay
*Assistant Examiner*—Sikha Roy
(74) *Attorney, Agent, or Firm*—Drinker Biddle & Reath LLP

(57) ABSTRACT

An inner surface of an electron-multiplier hole (14) includes a first curved surface (19*a*) and a second curved surface (19*b*) that face each other. The first curved surface (19*a*) extends from an edge of an input opening (14*a*) in such a way as to face the input opening (14*a*), and is shaped like a substantially circular arc having a predetermined radius. The second curved surface (19*b*) extends from an edge of an output opening (14*b*) in such a way as to face the output opening (14*b*), and is shaped like a substantially circular arc having a predetermined radius.

10 Claims, 7 Drawing Sheets

DYNODE PRODUCING METHOD AND STRUCTURE

TECHNICAL FIELD

This invention relates to a method of manufacturing dynodes, and relates to a structure of a dynode that is used for an electron multiplier, a photomultiplier, etc.

BACKGROUND ART

A dynode, such as one disclosed in Japanese Laid-Open Patent Application No. S60-182642, in Japanese Laid-Open Patent Application No. H5-182631, or in Japanese Laid-Open Patent Application No. H6-314551, is known as this type of dynode. The dynode disclosed in Japanese Laid-Open Patent Application No. S60-182642 is a perforated plate member having a plurality of inwardly curved through-holes (e.g., barrel-shaped through-holes), and each of the through-holes is symmetric about its vertical axis and about a median plane passing through the dynode. The input and output diameters of the through-holes are the same, and are smaller than the diameter of the inside of the through-holes. The dynode consists of two metal sheets, and is structured such that the sheets formed by etching are disposed back to back with each other so as to allow openings larger in diameter of the convergent or tapered hole to face each other.

The dynode disclosed in Japanese Laid-Open Patent Application No. H5-182631 and Japanese Laid-Open Patent Application No. H6-314551 includes a plate having a plurality of through-holes one end of each of which serves as an input opening and the other end of each of which serves as an output opening, and an inner surface of each of the through-holes has an inclined part that inclines with respect to the incident direction of an electron so that the incident electron from an incident opening collides therewith. The output opening of each through-hole is formed to have a bore diameter larger than the input opening.

Meanwhile, a secondary electron emitted from an nth-stage dynode ("th" is a suffix used to form ordinal numbers) is guided by a control electric field formed by a potential difference between the nth stage and the (n+1)th stage, and is caused to impinge on the (n+1)th-stage dynode. In the dynode disclosed in Japanese Laid-Open Patent Application No. S60-182642, the input diameter and the output diameter of the through-hole are the same, and therefore an equipotential line cannot sufficiently enter the inside of the through-hole of the nth stage that functions as a control electric field, and, disadvantageously, the control electric field inside the through-hole is weak. Therefore, there is a case in which the emitted secondary electron returns to the side of the nth stage, this forming one cause by which the efficiency of gathering electrons is lowered.

In contrast, in the dynode disclosed in Japanese Laid-Open Patent Application No. H5-182631, a through-hole is formed so that an output opening has a larger bore diameter than an input opening, and thereby the inner surface of the through-hole has a tapered shape that becomes gradually wider toward the output opening. Therefore, a control electric field for guiding a secondary electron to the next stage enters the through-hole from the output opening larger in bore diameter, and rises along the inner surface on the side opposite to an inclined part, and deeply enters the inside of the through-hole. As a result, the strength of the control electric field that can enter the inside of the through-hole increases, and the emitted secondary electron can be more reliably guided to the next-stage dynode, thus making it possible to improve the gathering efficiency of electrons.

DISCLOSURE OF THE INVENTION

Generally, as disclosed in Japanese Laid-Open Patent Application No. S60-182642, Japanese Laid-Open Patent Application No. H6-314551, etc., a dynode consists of two sheet metals (two metal plates), and is formed such that through-holes are formed in each of the sheet metals while using an etching technique, and, thereafter, the two sheet metals are bonded together and are integrally united.

However, in the dynode formed by bonding the two sheet metals together, there is the possibility that misalignment will occur between the sheet metals when the sheet metals are bonded together. Therefore, this dynode is at a disadvantage in the fact that the secondary electron cannot be appropriately guided because of the misalignment between the sheet metals, and the gathering efficiency of electrons decreases. In addition, disadvantageously, there is a need to design two sheet metals, and, resulting from the fact that a bonding step must be given in a manufacturing process, manufacturing costs of the dynode rise.

The present invention has been made in consideration of the foregoing circumstances. An object of the present invention is to provide a dynode-manufacturing method and a dynode structure capable of preventing the gathering efficiency of electrons from being lowered and capable of reducing manufacturing costs.

The dynode manufacturing method according to the present invention is characterized in that the dynode manufacturing method of forming a through-hole, one end of which serves as an input opening and the other end of which serves as an output opening, in a plate has a step of forming the input opening while etching a predetermined part of one side surface of the plate in such a way as to draw a first locus shaped like a substantially circular arc having a predetermined radius when seen from a direction parallel to the plate, and a step of forming the output opening while etching a predetermined part of an opposite surface of the plate in such a way as to draw a second locus shaped like a substantially circular arc that is in contact with the first locus or that overlaps the first locus when seen from the direction parallel to the plate, in which the second locus has a predetermined radius when seen from the direction parallel to the plate, and in which a center of the second locus is situated with a deviation in the direction parallel to the plate with respect to a center of the first locus.

In the dynode manufacturing method according to the present invention, the input opening is formed in one plate while etching the predetermined part of one side surface of the plate in such a way as to draw the first locus shaped like a substantially circular arc having the predetermined radius when seen from the direction parallel to the plate, and, on the other hand, the output opening is formed in the plate while etching the predetermined part of the opposite surface of the plate in such a way as to draw the second locus shaped like a substantially circular arc that is in contact with the first locus or that overlaps the first locus when seen from the direction parallel to the plate, in which the second locus has the predetermined radius when seen from the direction parallel to the plate, and in which the center of the second locus is situated with a deviation in the direction parallel to the plate with respect to the center of the first locus. Therefore, it becomes possible to form a through-hole in one plate. As a result, it becomes unnecessary to design two plates and to provide a step of bonding the plates together, thus making it possible to reduce the manufacturing costs of dynodes. In addition, since there is no need to bond two plates together, the misalignment of the plates bonded together never occurs unlike the aforementioned case, and an emitted secondary electron can be appropriately guided to a next-stage dynode, and the electron-gathering efficiency can be prevented from being lowered.

Preferably, the radius of the first locus is made smaller than that of the second locus. If the radius of the first locus is made smaller than that of the second locus in this way, a through-hole that has an output opening whose bore diameter is larger than an input opening can be very easily formed in a plate. As a result, it is possible to realize a dynode structured that can further improve electron-gathering efficiency at low manufacturing costs.

Preferably, the center of the first locus is situated inside one side surface of the plate when seen from the direction parallel to the plate. If the center of the first locus is situated inside one side surface of the plate when seen from the direction parallel to the plate in this way, a through-hole that has an output opening whose bore diameter is larger than an input opening can be very easily formed in a plate. As a result, it is possible to realize a dynode structured that can further improve electron-gathering efficiency at low manufacturing costs.

Preferably, the center of the second locus is situated inside the opposite surface of the plate or on the opposite surface of the plate when seen from the direction parallel to the plate. If the center of the second locus is situated inside the opposite surface of the plate or on the opposite surface of the plate when seen from the direction parallel to the plate in this way, a through-hole that has an output opening whose bore diameter is larger than an input opening can be very easily formed in a plate. As a result, it is possible to realize a dynode structured that can further improve electron-gathering efficiency at low manufacturing costs.

The structure of a dynode according to the present invention is characterized in that the dynode structure has a through-hole formed in one plate, one end of the through-hole serving as an input opening, an opposite end thereof serving as an output opening, in which an inner surface of the through-hole includes a first curved surface and a second curved surface that face each other, the first curved surface extends from an edge of the input opening in such a way as to face the input opening-and is shaped like a substantially circular arc having a predetermined radius when seen from a direction parallel to the plate, the second curved surface extends from an edge of the output opening in such a way as to face the output opening and is shaped like a substantially circular arc having a predetermined radius when seen from the direction parallel to the plate, and the output opening is formed to have a larger bore diameter than the input opening.

In the dynode structure according to the present invention, the inner surface of the through-hole includes the first curved surface and the second curved surface as described above, and therefore it becomes possible to form a through-hole in one plate, and it becomes unnecessary to design two plates and to provide a step of bonding the plates together, thus making it possible to reduce the manufacturing costs of dynodes. In addition, since there is no need to bond two plates together, misalignment of plates bonded together never occurs unlike the aforementioned case, and, since the output opening is formed to have a larger bore diameter than the input opening, an emitted secondary electron can be appropriately guided to a next-stage dynode, and the electron-gathering efficiency can be improved.

Preferably, the first curved surface and the second curved surface are formed such that a locus for forming the first curved surface and a locus for forming the second curved surface are in contact with each other or overlap each other. If the first curved surface and the second curved surface are formed such that the locus for forming the first curved surface and the locus for forming the second curved surface are in contact with each other or overlap each other in this way, a through-hole can be easily formed, and dynode-manufacturing costs can be further reduced.

Preferably, the radius of the first curved surface when seen from the direction parallel to the plate is smaller than the radius of the second curved surface when seen from the direction parallel to the plate. If the radius of the first curved surface when seen from the direction parallel to the plate is smaller than the radius of the second curved surface when seen from the direction parallel to the plate, it is possible to very easily form a through-hole, which has an output opening whose bore diameter is larger than an input opening, in the plate. As a result, it is possible to realize a dynode structured that can further improve electron-gathering efficiency at low manufacturing costs.

Preferably, the center of the first curved surface is situated inside one side surface of the plate when seen from the direction parallel to the plate. If the center of the first curved surface is situated inside one side surface of the plate when seen from the direction parallel to the plate in this way, it is possible to very easily form a through-hole, which has an output opening whose bore diameter is larger than an input opening, in the plate. As a result, it is possible to realize a dynode structured that can further improve electron-gathering efficiency at low manufacturing costs.

Preferably, the center of the second curved surface is situated inside an opposite surface of the plate or on the opposite surface of the plate when seen from the direction parallel to the plate. If the center of the second curved surface is situated inside the opposite surface of the plate or on the opposite surface of the plate when seen from the direction parallel to the plate in this way, it is possible to very easily form a through-hole, which has an output opening whose bore diameter is larger than an input opening, in the plate. As a result, it is possible to realize a dynode structured that can further improve electron-gathering efficiency at low manufacturing costs.

The dynode structure of the present invention is characterized in that the dynode structure includes a metallic plate in which a slit penetrating through upper and lower surfaces is formed and a secondary-electron-emitting layer disposed on an inner surface of the slit, in which each of two inner surfaces facing each other along a width direction of the slit has a curved surface that is curved in such a way as to enclose an axis along a lengthwise direction of the slit, and the deepest point of one of the curved surfaces along the width direction is situated outside the slit with respect to a straight line that extends in a thickness direction of the metallic plate from an edge of the slit nearest to the deepest point.

The curved surface does not necessarily need to be a part of a cylindrical face, and some deformation can be made. In order to prevent the electron-gathering efficiency from being lowered, it is necessary that a surface that extends from the deepest point of at least one of the curved surfaces to a corresponding edge should overhang. In this case, an electron can efficiently impinge on an opposite curved surface.

BEST MODE FOR CARRYING OUT THE INVENTION

Figure 1:
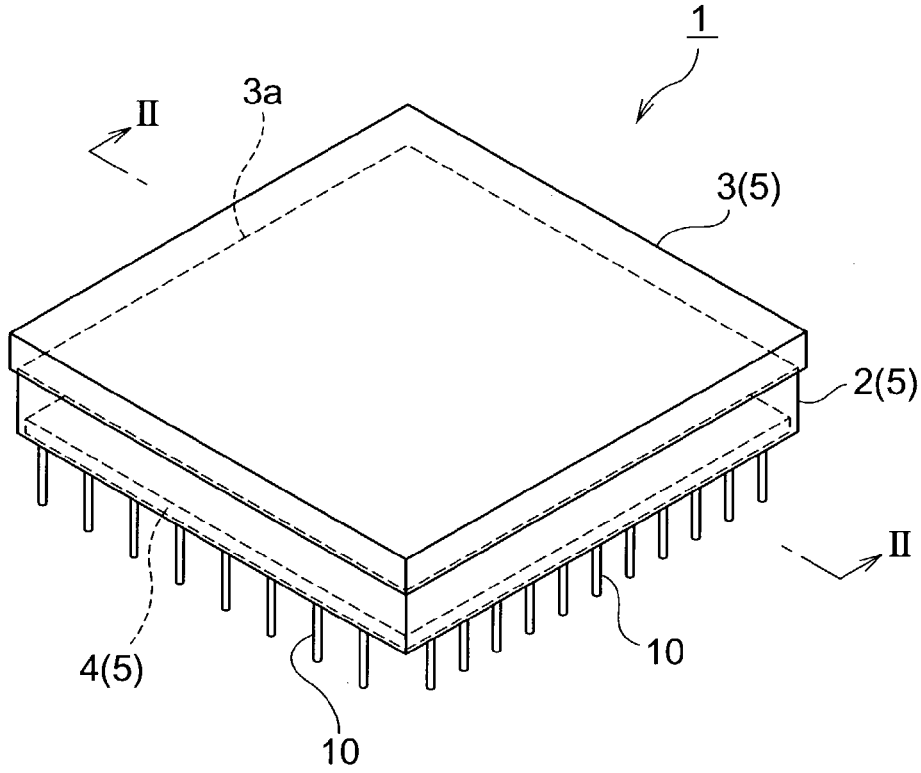
FIG. 1 is a perspective view showing a photomultiplier according to an embodiment of the present invention.

A detailed description will hereinafter be given of preferred embodiments of a dynode-manufacturing method and a dynode structure according to the present invention with reference to the attached drawings. In each figure, the same reference character is given to the same constituent element, and a description thereof is omitted. This embodiment shows an example in which the present invention is applied to a photomultiplier used for a radiation detector and the like.

Figure 2:
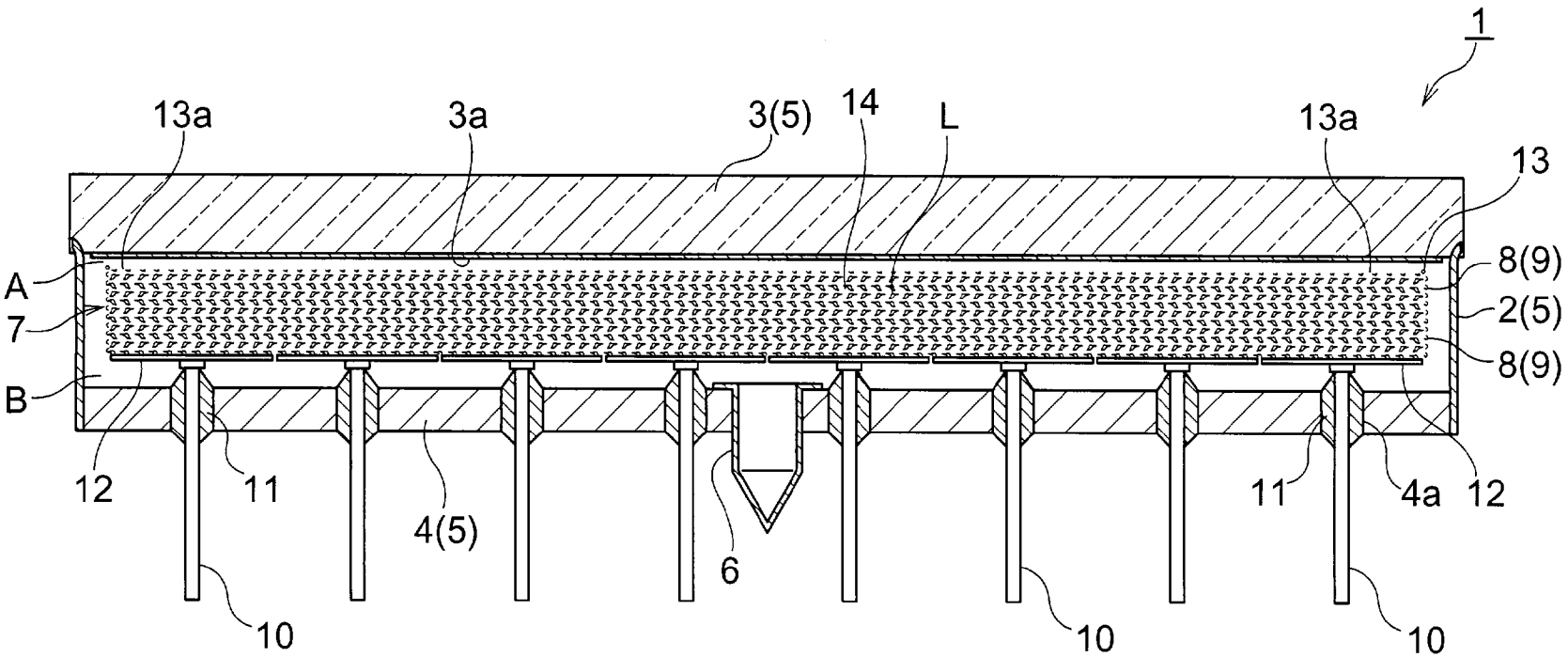
FIG. 2 is a sectional view along line II—II of FIG. 1.

FIG. 1 is a perspective view showing a photomultiplier according to a first embodiment, and FIG. 2 is a sectional view along line II—II of FIG. 1. The photomultiplier 1 shown in these figures has a metallic (e.g., Kovar-metallic or stainless-steel) bypass 2 shaped like a substantially regularly quadrilateral body. A glass-made (e.g., Kovar-glass-made or quartz-glass-made) light-receiving surface plate 3 is fused and fixed onto an opening end "A" formed at one side of the bypass 2. A photoelectric plane 3*a* used to convert light into an electron is formed on the inner surface of the light-receiving surface plate 3. The photoelectric plane 3*a* is formed by causing an alkali metal to react with antimony that has been vaporously pre-deposited on the light-receiving surface plate 3. A metallic (e.g., Kovar-metallic or stainless-steel) stem plate 4 is welded and fixed onto an opening end "B" of the bypass 2. A sealed vessel 5 is made up of the bypass 2, the light-receiving surface plate 3, and the stem plate 4 in this way. The sealed vessel 5 is an ultra thin type whose height is about 10 mm. The light-receiving surface plate 3 may be shaped like a polygon, such as a rectangle or a hexagon, without being limited to a square.

A metallic exhaust pipe 6 is fixed to the center of the stem plate 4. The exhaust pipe 6 is used to expel air from the inside of the sealed vessel 5 through a vacuum pump (not shown) so as to create a vacuum therein after completion of assembly of the photomultiplier 1, and is also used as a pipe through which an alkali metal vapor is introduced into the sealed vessel 5 when the photoelectric plane 3*a* is molded.

A block-like and multilayered type electron multiplier 7 is disposed in the sealed vessel 5. The electron multiplier 7 has an electron-multiplier part 9 in which ten sheets (ten stages) of planar dynodes 8 are stacked. In the sealed vessel 5, the electron multiplier 7 is supported by Kovar-metallic stem pins 10 provided to penetrate through the stem plate 4. The front end of each of the stem pins 10 is electrically connected to each of the dynodes 8. Pinholes 4*a* through which each stem pin 10 penetrates are formed in the stem plate 4. Each pinhole 4*a* is filled with a tablet 11 that is used as a Kovar-glass-made hermetic seal. Each stem pin 10 is fixed to the stem plate 4 by the tablet 11. Concerning the stem pin 10, there exist a stem pin used for dynodes and a stem pin used for anodes.

The electron multiplier 7 is provided with anodes 12 that are arranged side by side under the electron-multiplier part 9 and are each fixed to the upper end of the stem pin 10. On the uppermost stage of the electron multiplier 7, a flat focusing-electrode plate 13 is disposed between the photoelectric plane 3*a* and the electron-multiplier part 9. A plurality of slit-like openings 13*a* are formed in the focusing-electrode plate 13. All of the openings 13*a* are arranged to extend in the same direction. Likewise, a plurality of slit-like electron-multiplier holes 14 used to multiply electrons are formed and arranged in each dynode 8 of the electron-multiplier part 9. Herein, the electron-multiplier hole 14 is the through-hole recited in the appended claims.

A one-to-one correspondence is made between an electron-multiplier path L formed by arranging each electron-multiplier hole 14 of each dynode 8 in the stage direction and each opening 13*a* of the focusing-electrode plate 13, and thereby a plurality of channels are formed in the electron multiplier 7. The number of anodes 12 disposed in the electron multiplier 7 is 8×8 so as to correspond to each of a predetermined number of channels. Each anode 12 is connected to each stem pin 10, and thereby an individual output is drawn out to the outside through each stem pin 10.

Thus, the electron multiplier 7 has a plurality of linear channels. A predetermined voltage is supplied to the electron-multiplier part 9 and to the anode 12 by the given stem pin 10 connected to a breeder circuit (not shown). The photoelectric plane 3*a* and the focusing-electrode plate 13 are set at the same potential. The dynodes 8 and the anodes 12 are set to become higher in potential in order from the uppermost stage. Therefore, light that has impinged on the light-receiving surface plate 3 is converted into an electron by the photoelectric plane 3*a*. This electron enters a predetermined channel according to an electron-lens effect formed by the focusing-electrode plate 13 and by the first dynode 8 placed at the uppermost stage of the electron multiplier 7. In the channel that the electron has entered, the electron is subjected to multi-stage multiplication by the dynodes 8 while following the electron-multiplier path L of the dynode 8, and impinges on the anode 12. As a result, an individual output for a predetermined channel is sent from each anode 12.

Figure 3:
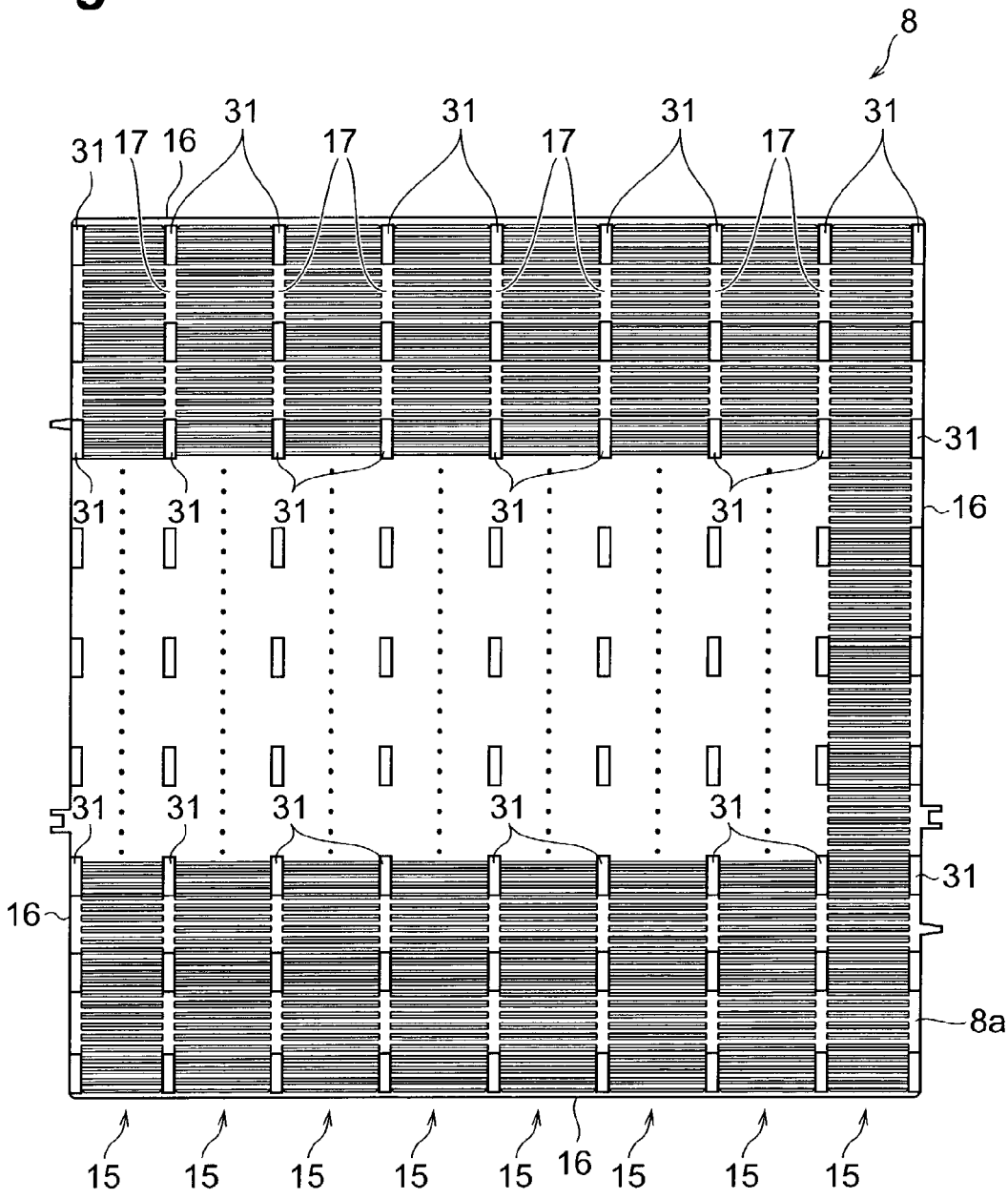
FIG. 3 is a plan view showing a dynode included in the photomultiplier according to the embodiment of the present invention.
Figure 4:
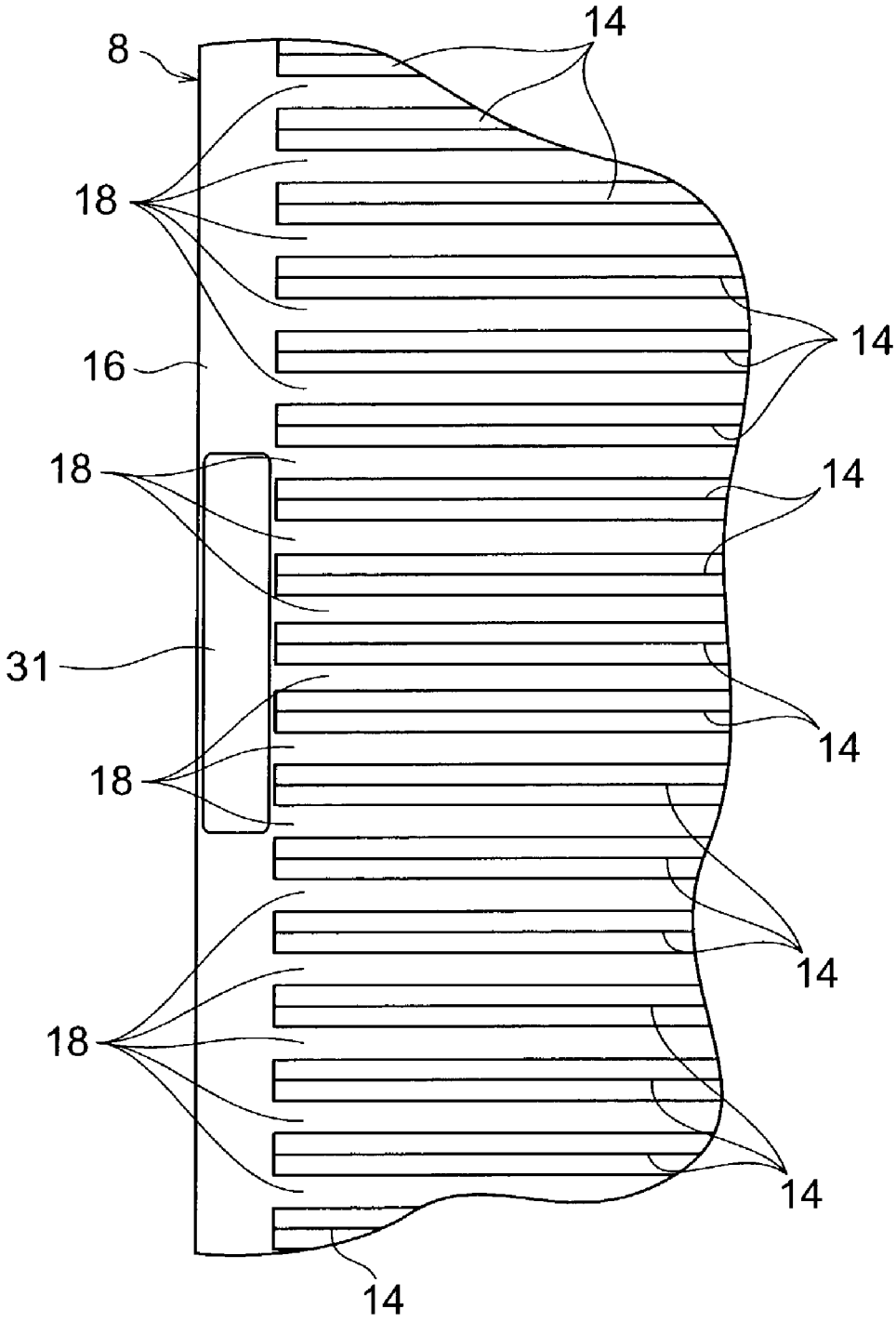
FIG. 4 is an enlarged plan view of a main part of the dynode included in the photomultiplier according to the embodiment of the present invention.
Figure 5:
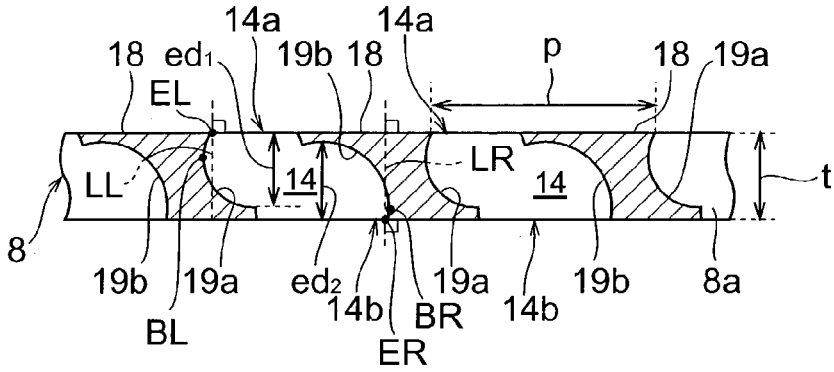
FIG. 5 is a sectional view of the main part of the dynode included in the photomultiplier according to the embodiment of the present invention.

Next, referring to FIG. 3 through FIG. 5, the structure of the aforementioned dynode 8 will be described in detail. FIG. 3 is a plan view showing the dynode 8, FIG. 4 is an enlarged plan view of a main part of the dynode 8, and FIG. 5 is a sectional view of the main part of the dynode 8.

Each dynode 8 consists of a plate 8*a* whose surface has electric conductivity. Eight-column channels 15 are formed in each dynode 8. Each channel 15 is made up of enclosures 16 and partition parts 17 of the dynode 8. Electron-multiplier holes 14 the number of which is the same as that of the openings 13*a* of the focusing-electrode plate 13 are arranged in each channel 15 by being subjected to, for example, chemical etching as described later. All of the electron-multiplier holes 14 extend in the same direction, and some of the electron-multiplier holes 14 are arranged in the direction perpendicular to the sheet. A multiplier-hole boundary 18 for partitioning is provided between the electron-multiplier holes 14. The width of the partition part 17 is determined according to an interval between the anodes 12, and is greater than that of the multiplier-hole boundary 18.

A substantially rectangular (about 0.19 mm×about 6.0 mm) input opening 14*a*, which is one end of the electron-multiplier hole 14, is formed at the upper surface of the plate 8*a* (dynode 8), and a substantially rectangular (about 0.3 mm×about 6.0 mm) output opening 14*b*, which is the other end of the electron-multiplier hole 14, is formed at the lower surface thereof. The output opening 14*b* is formed to have a larger bore diameter than the input opening 14*a*. In this embodiment, the thickness t of the plate 8*a* (dynode 8) is about 0.2 mm, and the pitch p of the electron-multiplier hole 14 is about 0.5 mm.

An inner surface of the electron-multiplier hole 14 includes a first curved surface 19*a* and a second curved surface 19*b* that face each other. The first curved surface 19*a* extends from the edge of the input opening 14*a* in such a way as to face the input opening 14*a*, and is shaped like a substantially circular arc having a predetermined radius (e.g., about 0.11 mm) when seen from the direction parallel to the plate 8*a*. The second curved surface 19*b* extends from the edge of the output opening 14*b* in such a way as to face the output opening 14*b*, and is shaped like a substantially circular arc having a predetermined radius (e.g., about 0.16 mm) when seen from the direction parallel to the plate 8*a*. The first curved surface 19*a* undergoes the vacuum deposition of antimony (Sb), and, by the reaction of alkali, forms a secondary-electron-emitting layer.

In this embodiment, the first curved surface 19*a* and the second curved surface 19*b* are formed such that an etching locus for forming the first curved surface 19*a* and an etching locus for forming the second curved surface 19*b* overlap each other. The center of the first curved surface 19*a* is situated inside one side surface (upper surface) of the plate 8*a* when seen from the direction parallel to the plate 8*a*. The center of the second curved surface 19*b* is situated inside the other surface (lower surface) of the plate 8*a* when seen from the direction parallel to the plate 8*a*. The center of the second curved surface 19*b* maybe situated on the other surface (lower surface) of the plate 8*a* when seen from the direction parallel to the plate 8*a*.

A dome-shaped glass part 31 may be bonded and fixed at predetermined positions of the enclosure 16 and the partition part 17 of each dynode 8. In this case, the glass part 31 is provided at a ratio of nine glass parts to one enclosure 16 or to one partition part 17, and, accordingly, eighty-one glass parts 31 are provided in total. The glass part 31 is bonded by applying glass to the enclosure 16 and to the partition part 17 and hardening it, and is shaped like a substantially semicircular cylinder whose convex is directed upward, i.e., a dome-shaped glass part. After the dome-shaped glass part 31 is bonded, the dynodes 8 are stacked on each other. As a result, the electron-multiplier part 9 is constructed by the stacked dynodes 8 with the glass part 31 therebetween.

In this embodiment, the stacked dynodes 8 and the glass parts 31 are brought into substantially linear contact with each other, and a joint area between the dynode 8 and the glass part 31 decreases. Therefore, warping of the dynode 8 can be prevented from occurring, and the dynodes 8 can be easily stacked on each other. In addition, since the dome-shaped glass part 31 is provided at predetermined positions of the enclosure 16 and the partition part 17, the area of a part (channel 15) where the electron-multiplier holes 14 are arranged, i.e., the perceptive light receiving area in the electron multiplier 7 (photomultiplier 1) can be controlled so as not to be reduced, and, based on this, the glass part 31 can be bonded to the dynode 8.

Figure 6:
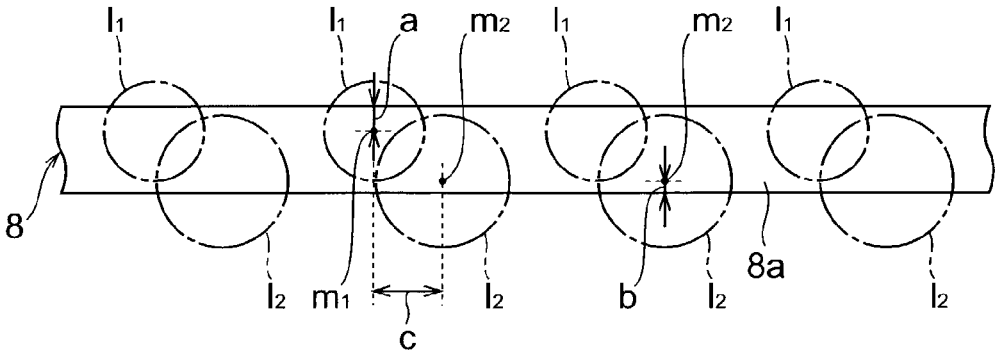
FIG. 6 is an explanatory drawing of a manufacturing method of a dynode included in the photomultiplier according to the embodiment of the present invention.

Next, the manufacturing method of the dynode 8 will be described with reference to FIG. 6. The dynode 8 forms an anti-etching mask having a predetermined shape on the upper and lower surfaces of the plate 8*a*, and, after that, chemical etching is applied to the single plate 8*a* in the following way. Thereby, an electron-multiplier hole 14 serving as a through-hole is formed. Chemical etching is applied to a predetermined part of one side surface (upper surface) side of the plate 8*a* in such a way as to draw a first locus $l_1$ shaped like a substantially circular arc having a predetermined radius (e.g., about 0.11 mm) when seen from the direction parallel to the plate 8*a*, thus forming the input opening 14*a*. On the other hand, chemical etching is applied to a predetermined part of the other surface (lower surface) side of the plate 8*a* in such a way as to draw a second locus $l_2$ shaped like a substantially circular arc, which has a predetermined radius (e.g., about 0.16 mm) when seen from the direction parallel to the plate 8*a*, the center $m_2$ of which is situated with a deviation in the direction parallel to the plate 8*a* with respect to the center $m_1$ of the first locus $l_1$, and which overlaps the first locus $l_1$ when seen from the direction parallel to the plate 8*a*, thus forming the output opening 14*b*. An interval c in the direction parallel to the plate 8*a* between the center $m_1$ of the first locus $l_1$ and the center $m_2$ of the second locus $l_2$ is set to be about 0.16 mm. When the input opening 14*a* and the output opening 14*b* are formed, a through-hole (electron-multiplier hole 14) is formed in the plate 8*a* by causing the first locus $l_1$ and the second locus $l_2$ to overlap each other.

In this embodiment, the center $m_1$ of the first locus $l_1$ is situated inside the upper surface of the plate 8*a* when seen from the direction parallel to the plate 8*a*, and a length "a" from the upper surface of the plate 8*a* to the center $m_1$ of the first locus $l_1$ is set to be about 0.06 mm. On the other hand, the center $m_2$ of the second locus $l_2$ is situated inside the lower surface of the plate 8*a* when seen from the direction parallel to the plate 8*a*, and a length "b" from the lower surface of the plate 8*a* to the center $m_2$ of the second locus $l_2$ is set to be about 0.03 mm. The center $m_2$ of the second locus $l_2$ may be situated on the lower surface of the plate 8*a* when seen from the direction parallel to the plate 8*a*.

Thus, the first curved surface 19*a* is formed by applying chemical etching to the plate 8*a* in such a way as to draw the first locus $l_1$. The etching depth ($ed_1/t\times100$) of the first curved surface 19*a* with respect to the thickness t of the plate 8*a* is 85% or more as shown in FIG. 5.

Likewise, the second curved surface 19*b* is formed by applying chemical etching to the plate 8*a* in such a way as to draw the second locus $l_2$. The etching depth ($ed_2/t\times100$) of the second curved surface 19*b* with respect to the thickness t of the plate 8*a* is 90% or more as shown in FIG. 5.

Next, referring to FIG. 7, a description will be given of the operation of the electron multiplier 7 (electron-multiplier part 9) using the dynode 8 structured as described above.

Figure 7:
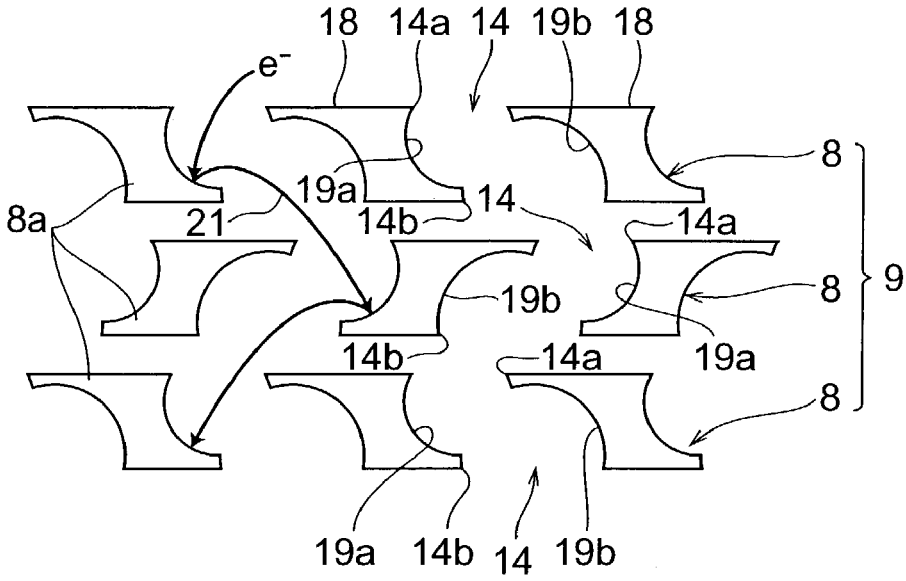
FIG. 7 is a view showing an electron orbit in an electron multiplier included in the photomultiplier according to the embodiment of the present invention.

FIG. 7 shows three consecutive stages of dynodes, which are taken out from a plurality of stages of the dynodes 8 that constitute the electron-multiplier part 9 of the electron multiplier 7. The dynodes 8 of the stages are stacked on each other while reversing the disposing direction of plates 8*a* per stage so that the curving direction of the first curved surface 19*a* (second curved surface 19*b*) becomes opposite between the upper and lower stages.

When a predetermined voltage is applied to each dynode 8 in this state, there are generated an equipotential line in a state of entering the electron-multiplier hole 14 from the output opening 14*b* of the preceding stage while being curved and an equipotential line in a state of entering the electron-multiplier hole 14 from the input opening 14*a* of the subsequent stage while being curved. Herein, since the output opening 14*b* is formed to have a larger bore diameter than the input opening 14*a*, the equipotential line entering from the output opening 14*b*, i.e., a control electric field by which a secondary electron is guided to a next stage reaches a state of deeply entering the interior of the electron-multiplier hole 14.

The thus deep entering of the equipotential line into the electron-multiplier hole 14 strengthens the control electric field of the inside of the electron-multiplier hole 14, and a secondary electron 21 emitted from the lower part of the first curved surface 19*a* of the preceding-stage dynode 8 is guided to the subsequent-stage dynode 8.

In the aforementioned embodiment, the first curved surface 19*a* and the second curved surface 19*b* are formed such that the etching locus for forming the first curved surface 19*a* and the etching locus for forming the second curved surface 19*b* overlap each other. However, as another embodiment, the first curved surface 19*a* and the second curved surface 19*b* may be formed such that the etching locus for forming the first curved surface 19*a* and the etching locus for forming the second curved surface 19*b* come in contact with each other.

Figure 8:
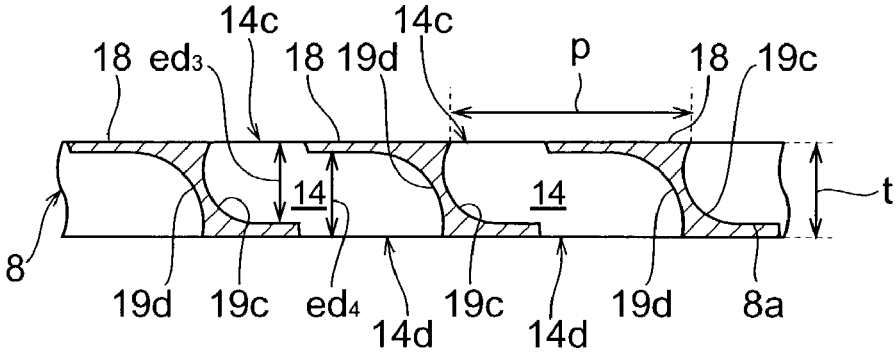
FIG. 8 is a sectional view of a main part showing another embodiment of the dynode.
Figure 9:
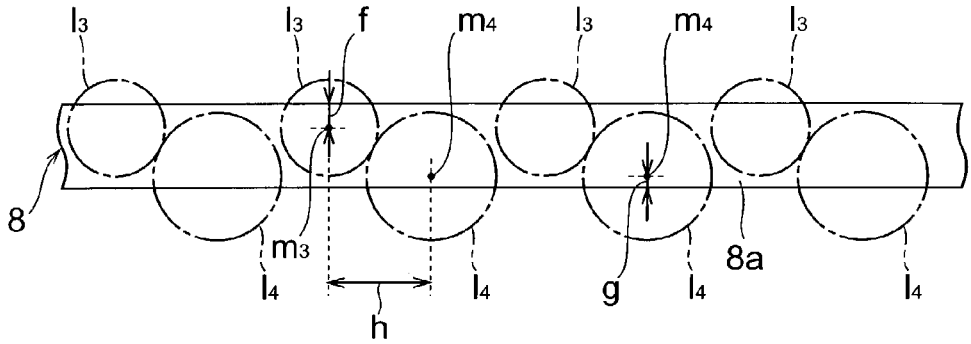
FIG. 9 is an explanatory drawing of a manufacturing method of the dynode shown in FIG. 8.
Figure 10:
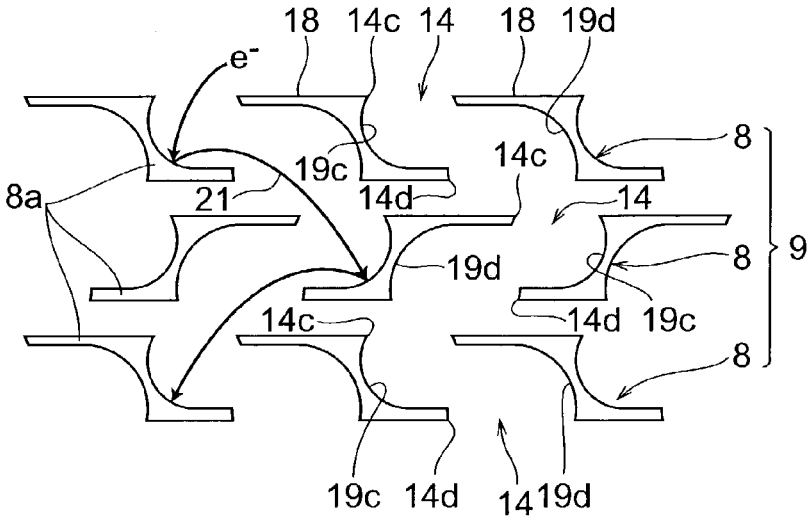
FIG. 10 is a view showing an electron orbit in an electron multiplier in which the dynode shown in FIG. 8 is laid on another dynode so as to form a multilayer.

Referring to FIG. 8 through FIG. 10, a description will hereinafter be given of an embodiment in which the etching locus for forming the first curved surface 19*a* and the etching locus for forming the second curved surface 19*b* are in contact with each other.

As shown in FIG. 8, a substantially rectangular (about 0.19 mm×about 6.0 mm) input opening 14*c*, which is one end of the electron-multiplier hole 14, is formed in the upper surface of the plate 8*a* (dynode 8), and a substantially rectangular (about 0.3 mm×about 6.0 mm) output opening 14*d*, which is the other end of the electron-multiplier hole 14, is formed in the lower surface thereof. The output opening 14*d* is formed to have a larger bore diameter than the input opening 14*c*. In this embodiment, the thickness t of the plate 8*a* (dynode 8) is about 0.2 mm, and the pitch p of the electron-multiplier hole 14 is about 0.5 mm.

An inner surface of the electron-multiplier hole 14 includes a first curved surface 19*c* and a second curved surface 19*d* that face each other. The first curved surface 19*c* extends from the edge of the input opening 14*c* in such a way as to face the input opening 14*c*, and is shaped like a substantially circular arc having a predetermined radius (e.g., about 0.11 mm) when seen from the direction parallel to the plate 8*a*. The second curved surface 19*d* extends from the edge of the output opening 14*d* in such a way as to face the output opening 14*d*, and is shaped like a substantially circular arc having a predetermined radius (e.g., about 0.16 mm) when seen from the direction parallel to the plate 8*a*. The first curved surface 19*c* undergoes the vacuum deposition of antimony (Sb), and, by the reaction of alkali, forms a secondary-electron-emitting layer.

In this embodiment, the first curved surface 19*c* and the second curved surface 19*d* are formed such that the etching locus for forming the first curved surface 19*c* and the etching locus for forming the second curved surface 19*d* come in contact with each other. The center of the first curved surface 19*c* is situated inside one side surface (upper surface) of the plate 8*a* when seen from the direction parallel to the plate 8*a*. The center of the second curved surface 19*d* is situated inside the other surface (lower surface) of the plate 8*a* when seen from the direction parallel to the plate 8*a*. The center of the second curved surface 19*d* may be situated on the other surface (lower surface) of the plate 8*a* when seen from the direction parallel to the plate 8*a*.

Next, the manufacturing method of the dynode 8 will be described with reference to FIG. 9. The dynode 8 forms an anti-etching mask having a predetermined shape on the upper and lower surfaces of the plate 8*a*, and, after that, chemical etching is applied to the single plate 8*a* in the following way. Thereby, an electron-multiplier hole 14 serving as a through-hole is formed. Chemical etching is applied to a predetermined part of one side surface (upper surface) side of the plate 8*a* in such a way as to draw a first locus $l_3$ shaped like a substantially circular arc having a predetermined radius (e.g., about 0.11 mm) when seen from the direction parallel to the plate 8*a*, thus forming the input opening 14*c*. On the other hand, chemical etching is applied to a predetermined part of the other surface (lower surface) side of the plate 8*a* in such a way as to draw a second locus $l_4$ shaped like a substantially circular arc, which has a predetermined radius (e.g., about 0.16 mm) when seen from the direction parallel to the plate 8*a*, the center $m_4$ of which is situated with a deviation in the direction parallel to the plate 8*a* with respect to the center $m_3$ of the first locus $l_3$, and which overlaps the first locus $l_3$ when seen from the direction parallel to the plate 8*a*, thus forming the output opening 14*d*. An interval h in the direction parallel to the plate 8*a* between the center $m_3$ of the first locus $l_3$ and the center $m_4$ of the second locus $l_4$ is set to be about 0.23 mm. When the input opening 14*c* and the output opening 14*d* are formed, the first locus $l_3$ and the second locus $l_4$ are caused to come in contact with each other, and the plate 8*a* is eroded by the etching, and, as a result, a through-hole (electron-multiplier hole 14) is formed in the plate 8*a*.

In this embodiment, the center $m_3$ of the first locus $l_3$ is situated inside the upper surface of the plate 8*a* when seen from the direction parallel to the plate 8*a*, and a length f from the upper surface of the plate 8*a* to the center $m_3$ of the first locus $l_3$ is set to be about 0.06 mm. On the other hand, the center $m_4$ of the second locus $l_4$ is situated inside the lower surface of the plate 8*a* when seen from the direction parallel to the plate 8*a*, and a length g from the lower surface of the plate 8*a* to the center $m_4$ of the second locus $l_4$ is set to be about 0.03 mm. The center $m_4$ of the second locus $l_4$ may be situated on the lower surface of the plate 8*a* when seen from the direction parallel to the plate 8*a*.

Thus, the first curved surface 19*c* is formed by applying chemical etching to the plate 8*a* in such a way as to draw the first locus $1_3$. The etching depth ($ed_3/t\times100$) of the first curved surface 19*c* with respect to the thickness t of the plate 8*a* is 85% or more as shown in FIG. 8.

Likewise, the second curved surface 19*d* is formed by applying chemical etching to the plate 8*a* in such a way as to draw the second locus $\mathbf{1}_4$. The etching depth ($ed_4/t\times100$) of the second curved surface 19*d* with respect to the thickness t of the plate 8*a* is 90% or more as shown in FIG. 8.

Next, referring to FIG. 10, a description will be given of the operation of the electron multiplier 7 (electron-multiplier part 9) using the dynode 8 structured as described above.

FIG. 10 shows three consecutive stages of dynodes, which are taken out from a plurality of stages of the dynodes 8 that constitute the electron-multiplier part 9 of the electron multiplier 7. The dynodes 8 of the stages are stacked on each other while reversing the disposing direction of plates 8*a* per stage so that the curving direction of the first curved surface 19*c* (second curved surface 19*d*) becomes opposite between the upper and lower stages.

When a predetermined voltage is applied to each dynode 8 in this state, there are generated an equipotential line in a state of entering the electron-multiplier hole 14 from the output opening 14*d* of the preceding stage while being curved and an equipotential line in a state of entering the electron-multiplier hole 14 from the input opening 14*c* of the subsequent stage while being curved. Herein, since the output opening 14*d* is formed to have a larger bore diameter than the input opening 14*c*, the equipotential line entering from the output opening 14*d*, i.e., a control electric field by which a secondary electron is guided to a next stage reaches a state of deeply entering the interior of the electron-multiplier hole 14.

The thus deep entering of the equipotential line into the electron-multiplier hole 14 strengthens the control electric field of the inside of the electron-multiplier hole 14, and a secondary electron 21 emitted from the lower part of the first curved surface 19*c* of the preceding-stage dynode 8 is guided to the subsequent-stage dynode 8.

Thus, according to the dynode 8 of the aforementioned embodiments, since the inner surface of the electron-multiplier hole 14 includes the first curved surfaces 19*a* and 19*c* and the second curved surfaces 19*b* and 19*d* as described above, it becomes possible to form the electron-multiplier hole 14 in the single plate 8*a*. As a result, it becomes unnecessary to design two plates and to provide a step of bonding the plates together, thus making it possible to reduce the manufacturing costs of the dynode 8. In addition, since there is no need to bond two plates together, the misalignment of the plates bonded together never occurs unlike the aforementioned case. Furthermore, since the output openings 14*b* and 14*d* are each formed to have a larger bore diameter than the input openings 14*a* and 14*c*, an emitted secondary electron 21 can be appropriately guided to the next-stage dynode 8, and electron-gathering efficiency can be improved.

Furthermore, since the first curved surfaces 19*a* and 19*c* and the second curved surfaces 19*b* and 19*d* are formed such that an etching locus (first loci $l_1$, $l_3$) for forming the first curved surfaces 19*a* and 19*c* and an etching locus (second loci $l_2$, $l_4$) for forming the second curved surfaces 19*b* and 19*d* come in contact with each other or overlap each other, the electron-multiplier hole 14 can be easily formed, and the manufacturing costs of the dynode 8 can be further reduced.

Furthermore, since the radius of the first curved surfaces 19*a* and 19*c* is made smaller than that of the second curved surfaces 19*b* and 19*d* when seen from the direction parallel to the plate 8*a*, the electron-multiplier hole 14 that has the output openings 14*b* and 14*d* whose bore diameter is larger than the input openings 14*a* and 14*c* can be very easily formed in the plate 8*a*. As a result, it is possible to realize the dynode 8 structured that can further improve electron-gathering efficiency at low manufacturing costs.

Furthermore, since the center of the first curved surfaces 19*a* and 19*c* is situated inside the upper surface of the plate 8*a* when seen from the direction parallel to the plate 8*a*, the electron-multiplier hole 14 that has the output openings 14*b* and 14*d* whose bore diameter is larger than the input openings 14*a* and 14*c* can be very easily formed in the plate 8*a*. As a result, it is possible to realize the dynode 8 structured that can further improve electron-gathering efficiency at low manufacturing costs.

Furthermore, since the center of the second curved surfaces 19*b* and 19*d* is situated inside the lower surface of the plate 8*a* or on the lower surface thereof when seen from the direction parallel to the plate 8*a*, the electron-multiplier hole 14 that has the output openings 14*b* and 14*d* whose bore diameter is larger than the input openings 14*a* and 14*c* can be very easily formed in the plate 8*a*. As a result, it is possible to realize a dynode 8 structured that can further improve electron-gathering efficiency at low manufacturing costs.

Further, according to the manufacturing method of the dynode 8 of the aforementioned embodiments, the input openings 14*a* and 14*c* are formed in the single plate 8*a* while etching the predetermined part of the upper surface of the plate 8*a* in such a way as to draw the first loci $l_1$, $l_3$ shaped as mentioned above, and, on the other hand, the output openings 14*b* and 14*d* are formed in the plate while applying chemical etching to the predetermined part of the lower surface of the plate 8*a* in such a way as to draw the second loci $l_2$, $l_4$ shaped as mentioned above. Therefore, it becomes possible to form the electron-multiplier hole 14*a* in the single plate 8*a*. As a result, it becomes unnecessary to design two plates and to provide a step of bonding the plates together, thus making it possible to reduce the manufacturing costs of the dynode. In addition, since there is no need to bond two plates together, misalignment of the plates bonded together never occurs unlike the aforementioned case, and an emitted secondary electron 21 can be appropriately guided to the next-stage dynode 8, and electron-gathering efficiency can be prevented from being lowered.

The present invention is not limited to the aforementioned embodiments, and can be carried out while appropriately changing the aforementioned numerical values and shapes. Although an example has been shown in which the present invention is applied to the photomultiplier 1 including the photoelectric plane 3*a*, it can, of course, be applied to an electron multiplier. Additionally, an etching technique other chemical etching can be used.

The structure of the aforementioned dynode is characterized in that the dynode structure includes a metallic plate (dynode 8) in which a slit 14 (electron-multiplier hole) penetrating through its upper and lower surfaces is formed and secondary-electron-emitting layers (19*a*, 19*b*, 19*c*, 19*d*: for convenience of explanation, they are designated by the same reference characters as the curved surfaces) disposed on the inner surface of the slit 14, in which each of the two inner surfaces facing each other along a width direction (direction of the pitch p) of the slit 14 has a curved surface (19*a*, 19*b*, 19*c*, 19*d*) that is curved in such a way as to enclose an axis (m1, m2, m3, m4) along a lengthwise direction (along the direction perpendicular to the sheet in FIG. 5 through FIG. 10) of the slit, and the deepest point (BL, BR) of one of the curved surfaces along the width direction is situated outside the slit 14 with respect to a straight line (LL, LR) that extends in a thickness direction of the metallic plate (dynode 8) from an edge (EL, ER) of the slit nearest to the deepest point (BL, BR) (see FIG. 5).

The curved surface does not necessarily need to be a part of a cylindrical face, and some deformation can be made. In order to prevent the electron-gathering efficiency from being lowered, it is necessary that a surface that extends from the deepest point (BL) of at least one of the curved surfaces (19*a*) to a corresponding edge (EL) should overhang. In this case, an electron can efficiently impinge on the opposite curved surface 19*b*. If the curved surface 19*b* satisfies the same condition as the curved surface 19*a*, the electron-gathering efficiency further increases. These features are also applied to the dynode shown in FIG. 7 and in the figures subsequent to this.

As described above in detail, according to the present invention, it is possible to provide a dynode manufacturing method and a dynode structure capable of preventing the electron gathering efficiency from being lowered and capable of reducing manufacturing costs.

INDUSTRIAL APPLICABILITY

The present invention can be applied to a dynode manufacturing method and a dynode structure that can be used for an electron multiplier, a photomultiplier, etc.

The invention claimed is:

1. A dynode manufacturing method for forming a through-hole, one end of which serves as an input opening and an opposite end of which serves as an output opening, in a plate, comprising:

a step of forming the input opening while etching a predetermined part of one side surface of the plate in such a way as to draw a first locus shaped like a substantially circular arc having a predetermined radius when seen from a direction parallel to the plate; and a step of forming the output opening while etching a predetermined part of an opposite surface of the plate in such a way as to draw a second locus shaped like a substantially circular arc that comes in contact with the first locus or that overlaps the first locus when seen from the direction parallel to the plate, the second locus having a predetermined radius when seen from the direction parallel to the plate, a center of the second locus being situated with a deviation in the direction parallel to the plate with respect to a center of the first locus.

2. The dynode manufacturing method according to claim 1, wherein a radius of the first locus is made smaller than that of the second locus.

3. The dynode manufacturing method for forming a through-hole, one end of which serves as an input opening and an opposite end of which serves as an output opening, in a plate, comprising:

a step of forming the input opening while etching a predetermined part of one side surface of the plate in such a way as to draw a first locus shaped like a substantially circular arc having a predetermined radius when seen from a direction parallel to the plate; and a step of forming the output opening while etching a predetermined part of an opposite surface of the plate in such a way as to draw a second locus shaped like a substantially circular arc that comes in contact with the first locus or that overlaps the first locus when seen from the direction parallel to the plate, the second locus having a predetermined radius when seen from the direction parallel to the plate, a center of the second locus being situated with a deviation in the direction parallel to the plate with respect to a center of the first locus, wherein the center of the first locus is situated inside the one side surface of the plate when seen from the direction parallel to the plate.

4. A dynode manufacturing method for forming a through-hole, one end of which serves as an input opening and an opposite end of which serves as an output opening, in a plate, comprising:

a step of forming the input opening while etching a predetermined part of one side surface of the plate in such a way as to draw a first locus shaped like a substantially circular arc having a predetermined radius when seen from a direction parallel to the plate; and a step of forming the output opening while etching a predetermined part of an opposite surface of the plate in such a way as to draw a second locus shaped like a substantially circular arc that comes in contact with the first locus or that overlaps the first locus when seen from the direction parallel to the plate, the second locus having a predetermined radius when seen from the direction parallel to the plate, a center of the second locus being situated with a deviation in the direction parallel to the plate with respect to a center of the first locus.

wherein the center of the first locus is situated inside the one side surface of the plate when seen from the direction parallel to the plate, and the center of the second locus is situated inside the opposite surface of the plate or on the opposite surface of the plate when seen from the direction parallel to the plate.

5. A dynode structure, which has a through-hole formed in one plate, one end of the through-hole serving as an input opening, an opposite end thereof serving as an output opening, wherein an inner surface of the through-hole includes a first curved surface and a second curved surface that face each other, the first curved surface extends from an edge of the input opening in such a way as to face the input opening, and is shaped like a substantially circular arc having a predetermined radius when seen from a direction parallel to the plate, the second curved surface extends from an edge of the output opening in such a way as to face the output opening, and is shaped like a substantially circular arc having a predetermined radius when seen from the direction parallel to the plate;

the output opening is formed to have a larger bore diameter than the input opening;

a first center of the circular arc of said first curved surface is located inside the plate; and a second center of the circular arc of said second curved surface is located inside the plate.

6. The dynode structure according to claim 5, wherein the first curved surface and the second curved surface are formed such that a locus for forming the first curved surface and a locus for forming the second curved surface come in contact with each other or overlap each other.

7. The dynode structure according to claim 5, wherein the radius of the first curved surface when seen from the direction parallel to the plate is smaller than that of the second curved surface when seen from the direction parallel to the plate.

8. A dynode structure, which has a through-hole formed in one plate, one end of the through-hole serving as an input opening, an opposite end thereof serving as an output opening, wherein an inner surface of the through-hole includes a first curved surface and a second curved surface that face each other, the first curved surface extends from an edge of the input opening in such a way as to face the input opening, and is shaped like a substantially circular arc having a predetermined radius when seen from a direction parallel to the plate, the second curved surface extends from an edge of the output opening in such a way as to face the output opening, and is shaped like a substantially circular arc having a predetermined radius when seen from the direction parallel to the plate;

the output opening is formed to have a larger bore diameter than the input opening, the center of the first curved surface is situated inside the one side surface of the plate when seen from the direction parallel to the plate, and the second locus for forming the second curved surface that comes in contact with the first locus for forming the first curved surface or that overlaps the first locus when seen from the direction parallel to the plate.

9. A dynode structure, which has a through-hole formed in one plate, one end of the through-hole serving as an input opening, an opposite end thereof serving as an output opening, wherein an inner surface of the through-hole includes a first curved surface and a second curved surface that face each other, the first curved surface extends from an edge of the input opening in such a way as to face the input opening, and is shaped like a substantially circular arc having a predetermined radius when seen from a direction parallel to the plate, the second curved surface extends from an edge of the output opening in such a way as to face the output opening, and is shaped like a substantially circular arc having a predetermined radius when seen from the direction parallel to the plate;

the output opening is formed to have a larger bore diameter than the input opening, and the center of the second curved surface is situated inside the opposite surface of the plate or on the opposite surface of the plate when seen from the direction parallel to the plate.

10. A dynode structure, which includes a metallic plate in which a slit penetrating through the upper and lower surfaces is formed and a secondary-electron-emitting layer disposed on an inner surface of the slit, wherein each of two inner surfaces facing each other along a width direction of the slit has a curved surface that is curved in such a way as to enclose an axis along a lengthwise direction of the slit, the deepest point of one of the curved surfaces along the width direction being situated outside the slit with respect to a straight line that extends in a thickness direction of the metallic plate from an edge of the slit nearest to the deepest point.

* * * * *